United States Patent [19]

Davis

[11] 4,337,723

[45] Jul. 6, 1982

[54] PIPE INTERIOR SURFACE COATING DEVICE

[76] Inventor: J. C. Davis, 9818 Hathaway, Dallas, Tex. 75220

[21] Appl. No.: 216,287

[22] Filed: Dec. 15, 1980

[51] Int. Cl.[3] ..... B05C 7/02; B05C 7/08

[52] U.S. Cl. ..... 118/306; 118/DIG. 10

[58] Field of Search ..... 118/105, 306, 317, DIG. 10; 15/104.05, 406; 51/411; 427/236

[56] References Cited

U.S. PATENT DOCUMENTS 2,348,505 5/1944 Voerge ..... 51/411

3,606,862 9/1971 Huff et al. ..... 118/306

3,987,963 10/1976 Pacht ..... 118/306 X 4,181,092 1/1980 Johnson ..... 118/306 X

*Primary Examiner*—John P. McIntosh

*Attorney, Agent, or Firm*—Gerald G. Crutsinger; John F. Booth; Monty L. Ross

[57] ABSTRACT

A pipe interior surface coating device having a spray apparatus for distributing a coating material around an axis of rotation. A carriage supports the spray apparatus and is adapted to be moved longitudinally inside a pipe. A bracket may be used to position the spray apparatus at a chosen distance away from one end of the carriage and the carriage may include apparatus to position the axis of rotation of the spray means concentrically within the pipe.

8 Claims, 3 Drawing Figures

PIPE INTERIOR SURFACE COATING DEVICE

BACKGROUND AND BRIEF SUMMARY OF INVENTION

This invention generally relates to Pipe Interior Surface Coating Devices and, more specifically, to airless type spray devices used in painting the interior surface of a pipe.

In U.S. Pat. No. 3,915,382, I described an airless type extension spray gun enabling a painter to reach high overhead locations without the use of ladders. This extension spray gun apparatus basically comprises a pole, which is telescopically extendable having a locking device to lock it at any length desired, a spray nozzle pivotally connected to one end of the pole, and a valve located at the other end of the pole with the flexible hose extending between the valve and spray nozzle. I have since determined that this type spray gun might be used beneficially in painting the interior surface of pipes. However, because of the uneven spray and back pressures which occur when spraying in a closed location, I have found that this apparatus is difficult to use in spraying the interior surface of a pipe.

I then developed apparatus comprising a pole, which is telescopically extendable. A spray head having opposed nozzles is rotatably secured to one end of the pole and a valve is located at the other end of the pole. A flexible hose extends through the pole between the valve and the spray head to supply a coating material to the head. Self centering telescoping guide arms are used to position the axis of rotation of the spray head nozzle along the longitudinal axis of the pipe such that the two axes coincide to assure an even distribution of coating material or paint on the interior surface of the pipe. This device is described in an article entitled "Taking the 'Pain' Out of Painting", *Engineering Notes.* by Mr. Theodore Dowd, Ocean Engineering Division, U.S. Coast Guard Headquarters, Winter, 1978.

A number of other devices for coating the interior surface of a pipe are described in U.S. Pat. Nos. 2,520,397; 3,606,862; 3,960,644; and 3,987,963; and in British Patent Specification No. 400,363. However, none of these pipe interior surface coating devices provide an even distribution of coating material to the interior surface as desirable because none of the devices have a rotating spray head with connecting apparatus to adjustably connect spray tips to whirler tubes for varying the angle of each spray tip relative to a radial line extending from the axis of rotation so that the rotational speed of the spray tips may be adjusted. Further, no prior art device provides even distribution because the devices do not employ a rotating spray head supported by apparatus permitting a longitudinal displacement of the spray head from the supporting apparatus. Further, devices heretofore developed could not provide even distribution of the paint in pipes of different diameters because the supporting apparatus was not adjustable to maintain the axis of rotation of the spray head aligned with the axis of the pipe and then fixed in such adjusted position.

Accordingly, it is an object of the present invention to provide a pipe interior surface coating device that supplies an even distribution of coating material to a pipe section by using apparatus which permits positioning of the rotating spray head a chosen distance outwardly or longitudinally of the support apparatus carrying the spray head through the pipe section being coated.

Further, it is an object of the present invention to provide a pipe interior surface coating device that supplies an even distribution of coating material to the interior surface of a pipe by varying the rotating speed of the rotating spray head.

In accordance with the invention, a pipe interior surface coating device, comprises a spray apparatus for distributing a coating material around an axis of rotation. A carriage supports the rotating spray apparatus for movement longitudinally through a pipe section. The carriage includes a frame with first and second ends and first and second sets of rollers for supporting each end of the frame. A leg is pivotally connected to each roller and a sleeve for receiving each leg is connected to the frame. A screw is threadedly connected to each sleeve for urging the leg received therein into engagement with a side of the sleeve. The rollers are thus moved radially of the axis of rotation when the leg is not engaging the sleeve to thereby position the axis of rotation of the spray apparatus concentrically within the pipe and then fixed in position by engagement of the leg with the sleeve.

Further, in accordance with the invention, a pipe interior surface coating device comprises a carriage adapted to be moved longitudinally inside a pipe section having first and second ends. A bracket is supported by the carriage and has a first and second end. A rotating spray apparatus is connected to the second end of the bracket for distributing a coating material around an axis of rotation. Apparatus is used to connect the bracket to the carriage when the rotating spray apparatus is disposed a chosen distance longitudinally of the second end of the carriage.

Further, in accordance with the invention, a pipe interior surface coating device, comprises a carriage adapted to be moved longitudinally inside a pipe. A spray apparatus is supported by the carriage for distributing a coating material around an axis of rotation. The rotating spray apparatus includes a swivel, a set of whirler tubes disposed to receive coating material and connected to the swivel for rotating around the axis of rotation of the spray apparatus, and a spray tip disposed in fluid communication with each whirler tube for directing a coating material toward the interior surface of the pipe. Apparatus is used to adjustably connect each spray tip to each whirler tube to vary the angle of the spray tip relative to a radial line extending from the axis of rotation so as to adjust the rotational speed of the spray tips around the axis of rotation.

BRIEF DESCRIPTION OF THE DRAWINGS

Other objects and advantages of the invention will become apparent upon reading the following detailed description and upon reference to the drawings in which like reference characters are used throughout to designate like parts.

DETAILED DESCRIPTION OF THE INVENTION

Turning now to the drawings, a pipe interior surface coating device 10 is shown disposed in a tubular pipe section 12. Apparatus 14 is provided exteriorly of pipe section 12 to supply a coating material, such as paint, through a flexible hose 16 into pipe section 12 to device 10. Although hose 16 is of conventional material, this material is chosen to have sufficient strength to enable device 10 to be pulled through pipe section 12.

Figure 2:
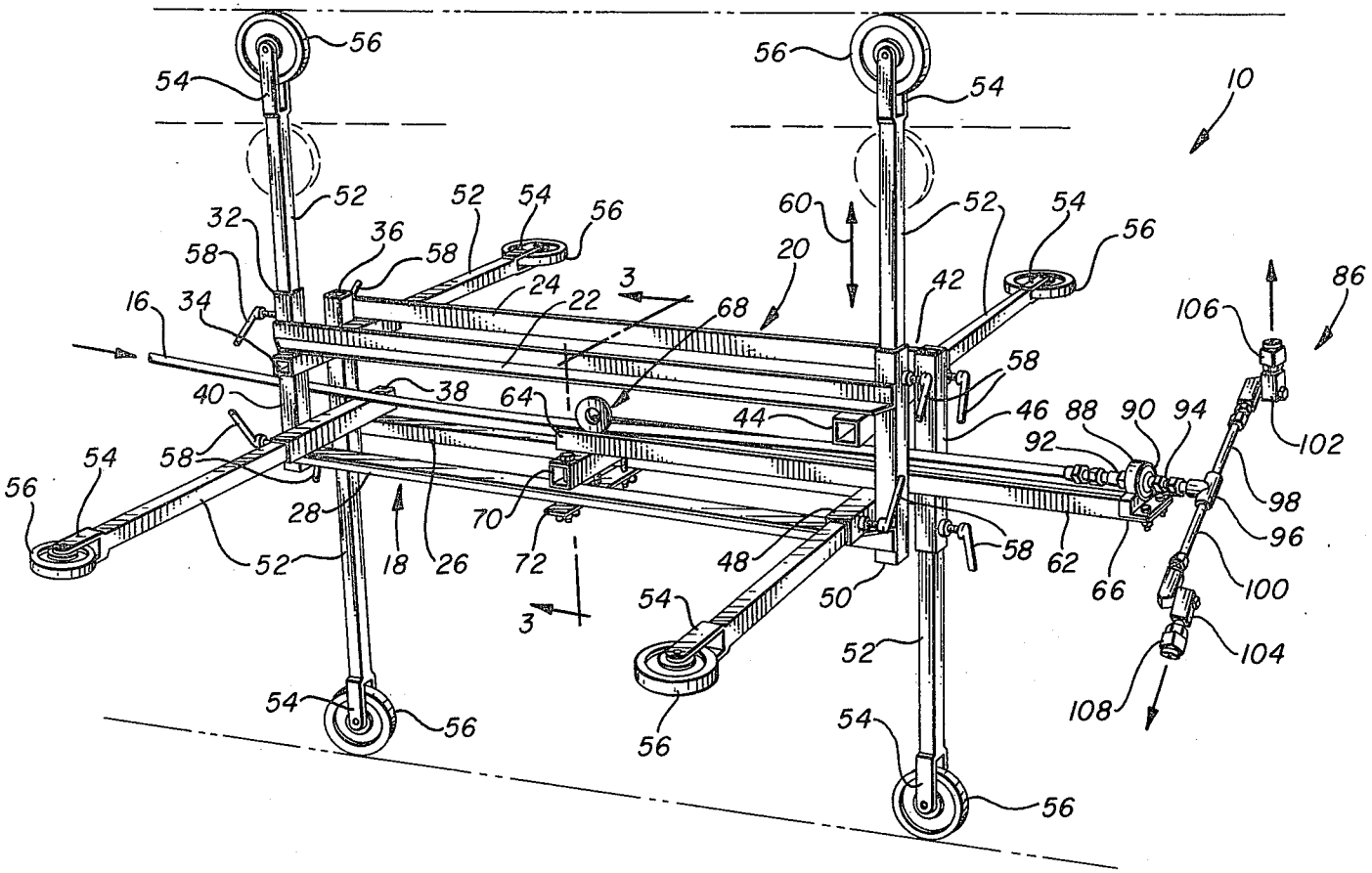
FIG. 2 is a perspective view of the preferred embodiment shown in FIG. 1.

Coating device 10 includes a carriage 18 adapted to be moved longitudinally through the inside of pipe section 12. Carriage 18 has a support frame 20 consisting of four members 22, 24, 26 and 28 interconnected at first end 32 by sleeves 34, 36, 38 and 40, and interconnected at second end 42 by sleeves 44, 46, 48 and 50. Members 22 and 24 are connected at end 32 by sleeve 34 and at end 42 by sleeve 44. Members 24 and 26 are connected at end 32 by sleeve 36 and at end 42 by sleeve 46. Members 26 and 28 are connected at end 32 by sleeve 38 and at end 42 by sleeve 48. Members 28 and 22 are connected at end 32 by sleeve 40 and at end 42 by sleeve 50. Support frame 20 is thus in the form of a crate-like shape with members 34, 36, 38 and 40 extending longitudinally of pipe section 12. Each sleeve receives one end of leg 52 with the other end of leg 52 having a fork 54 provided therein for pivotly supporting a wheel 56 at the wheel's central axis. A screw 58 is provided through a wall of each sleeve to engage the side of the leg 52 and fasten leg 52 in a position disposed radially of the axis of pipe section 12. Each screw 58 is of conventional design and is typically called a wing screw. As shown in solid and dotted outline in FIG. 2, by disengaging screw 58 from each leg 52, wheels 56 may be positioned nearer or farther, as represented by arrow 60, relative to frame 20. It is preferred that sleeves 34, 36, 38, 40, 44, 46, 48 and 50 and legs 52 have a matching rectilinear cross-section, such as a square or rectangle, so that wheels 56 are positioned with the central axis disposed to enable each wheel to roll longitudinally along pipe section 12.

Figure 1:
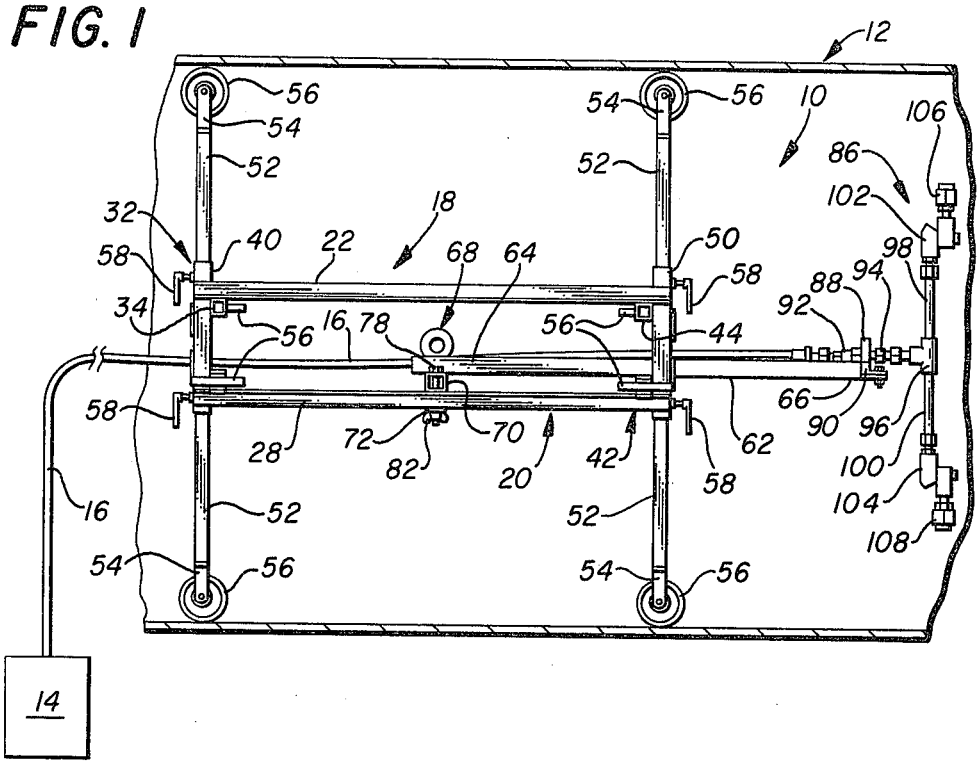
FIG. 1 is an elevational view of a pipe section having an embodiment of the invention disposed therein.
Figure 3:
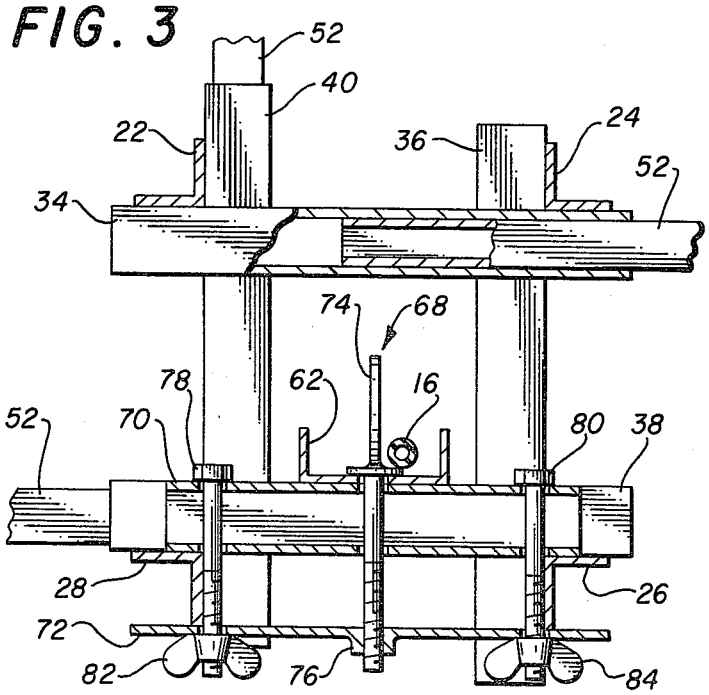
FIG. 3 is an enlarged, cross-sectional view of the preferred embodiment shown in FIG. 2, taken along lines 3—3 and in the direction of the arrows.

An elongated bracket 62 is connected to support frame 20 and has a first end 64 and a second end 66. Attaching apparatus 68 is provided on first end 64 for fixing second or outboard end 66 a chosen distance outwardly or longitudinally of second end 42 of frame 20. The distance chosen is disposed a distance sufficiently away from carriage 18 such that the coating material spray does not impinge on the carriage, while being sufficiently close to the carriage to inhibit vibration. As best seen in FIG. 3, attaching apparatus 68 includes an upper clamp member 70 and a lower clamp plate 72 extending over and under members 26 and 28 for clamping these members therebetween to attach first end 64 of bracket 62 to support frame 20. A wing screw 74 extends through aligned openings in bracket 62 and upper clamp member 70, and threadedly engages nut member 76 provided on lower clamp plate 72. To insure bracket 62 is securely affixed to frame 20, bolts 78 and 80 are provided to extend through openings in upper clamp member 70 for connection to wing nuts 82 and 84, respectively.

A rotating spray apparatus or head 86 is connected to second or outboard end 66 of bracket 62 for distributing a coating material around an axis of rotation, which is aligned with the axis of pipe section 12. Spray apparatus 86 includes a conventional swivel 88 set in a ball bearing bracket 90, which is bolted to end 66 of bracket 62. On one side of swivel 88 is a connection 92 for connecting hose 16 thereto and on the other side of swivel 88 is a connection 94 mounted to a T-connection 96. Thus, the axis of rotation of rotating spray apparatus 86 coincides with the axis of rotation of swivel 88, which is positioned in pipe section 17 by legs 52 and wheels 56. Further, T-connection 96 is disposed in fluid communication with hose 16 to receive the coating material therein. A set of whirler tubes (preferably two tubes) 98 and 100 have one end connected to each side of T-connecting 96 and the other end connected through swivel connectors 102 and 104 to spray tips or nozzles 106 and 108, respectively. Thus, spray tips 106 and 108 may be adjusted relative to a radial line extending from the axis of rotation (the radial line being disposed coaxially with whirler tubes 98 and 100) so as to adjust the rotational speed of spray head 86 for the assigned painting task. It should also be understood that although two whirler tubes and spray tips are used, additional spray tips may be used.

In operation, carriage 18 is positioned in pipe section 12 and screws 58 moved to disengage each leg 52. Support frame 20 is then moved until the axis of rotation of swivel 88 is disposed concentrically within pipe section 12 and wheels 56 moved into engagement with the interior surface of the pipe section. Screws 58 are then rotated until the legs are clamped to support frame 20 with the wheels engaging the interior surface of the pipe section. Attaching apparatus 68 on bracket 62 is disengaged from support frame 20 and spray tips 106 and 108 are then adjusted to vary the angle relative to a radial line extending from the axis of rotation to insure an even distribution of coating material onto the interior surface of the pipe as well as to adjust the rotational speed of the spray tips around the axis of rotation. Device 10 is then moved to one end of pipe section 12 to insure rotating spray head 86 is concentrically positioned in the pipe throughout the length of pipe section 12. Coating material supply apparatus 14 is then activated to provide a spray through nozzles 106 and 108 and device 10 is drawn through the length of pipe section 12 by use of hose 16 to provide an even distribution of coating material along the length of the pipe section.

The invention having been described, what is claimed is:

1. A pipe interior surface coating device, comprising: a carriage adapted to be supported within a pipe near the longitudinal central axis of said pipe and to be moved longitudinally inside said pipe; and spray means for applying coating material to the interior surface of said pipe including bracket means mounted on said carriage and having one end thereof extending past a first end of said carriage, a rotating sprayer assembly mounted on said one end of said bracket for rotation about an axis essentially parallel to said central pipe axis, said rotating sprayer assembly comprising a swivel member at said axis of rotation, whirler tubes extending radially from said swivel member and nozzle means attached to the outer end of each whirler tube, and means to receive a supply of said coating material, said swivel member and said whirler tubes forming fluid conduits for delivery of said coating material from said receiving means to said nozzle means and means to adjustably position each nozzle means for discharge of said coating material toward the interior surface of said pipe and at an angle relative to a radial line extending from the axis of rotation of said rotating sprayer assembly whereby impetus is provided to drive said assembly at a selected rotational speed.

2. A coating device as set forth in claim 1, wherein said carriage includes a frame, first and second sets of rollers mounted on the frame, and means for adjustably positioning the sets of rollers radially of the axis of rotation of said rotating sprayer assembly such that the axis of rotation of said rotating sprayer assembly is concentrically disposed in each particular pipe section.

3. The pipe coating device defined in claim 2 wherein said means for adjustably positioning said rollers comprise sleeve and leg structures mounting said rollers to said carriage.

4. The pipe coating device defined in claim 3 wherein said rollers are wheels.

5. The pipe coating device defined in claim 2 wherein said rollers are wheels.

6. The pipe coating device as defined in any of claims 1, 2, 3, 5 or 4 in which said bracket is adjustably mounted on said carriage whereby said rotating sprayer assembly may be selectively positioned relative to said first end of said carriage.

7. The pipe coating device defined in claim 6 further including means to supply coating material to said rotating sprayer assembly from a reservoir exterior of said pipe and means to move said carriage longitudinally through said pipe in a direction away from the coated portion of the pipe surface.

8. The pipe coating device defined in claim 7 wherein said means to supply and said means to move together comprise flexible conduit means connected to said means to receive said coating material.

* * * * *